US010684042B2

(12) United States Patent
Brown et al.

(10) Patent No.: US 10,684,042 B2
(45) Date of Patent: Jun. 16, 2020

(54) CHEMICAL REACTION HEATING SYSTEM

(71) Applicants: Glenn Norman Brown, Williamsburg, VA (US); Earl Cleveland Bryant, II, Colorado Springs, CO (US)

(72) Inventors: Glenn Norman Brown, Williamsburg, VA (US); Earl Cleveland Bryant, II, Colorado Springs, CO (US)

( * ) Notice: Subject to any disclaimer, the term of this patent is extended or adjusted under 35 U.S.C. 154(b) by 1001 days.

(21) Appl. No.: 14/173,402

(22) Filed: Feb. 5, 2014

(65) Prior Publication Data

US 2014/0224242 A1 Aug. 14, 2014

Related U.S. Application Data

(60) Provisional application No. 61/762,975, filed on Feb. 11, 2013.

(51) Int. Cl.
*F24V 30/00* (2018.01)

(52) U.S. Cl.
CPC ..... *F24V 30/00* (2018.05)

(58) Field of Classification Search
CPC ..... F24J 1/00; F24J 2/07
See application file for complete search history.

(56) References Cited

U.S. PATENT DOCUMENTS 2,621,648 A * 12/1952 Carfano ..... E05B 17/0016 126/263.01
3,229,681 A * 1/1966 Gluckstein ..... A41D 13/0051 126/204
3,942,510 A * 3/1976 Garrett ..... A47J 36/28 126/263.05
4,193,388 A * 3/1980 Frosch ..... F24V 30/00 126/263.01
5,964,221 A 10/1999 McKenna
8,833,078 B2 * 9/2014 Galloway ..... F24J 1/00 60/645
2005/0070848 A1 * 3/2005 Kim ..... A61M 5/2053 604/140
2006/0230633 A1 * 10/2006 Polenta ..... A43B 7/02 36/2.6
2011/0194846 A1 * 8/2011 Wang ..... B82Y 30/00 392/482
2012/0210996 A1 8/2012 Pollock

* cited by examiner

*Primary Examiner* — Jason Lau
(74) *Attorney, Agent, or Firm* — Deidre McAuley

(57) ABSTRACT

A chemical reaction heating system includes a valved mask to capture and direct carbon dioxide from a user's exhaled breath into a tube or air intake chamber, a connecting mechanism to attach and control flow of carbon dioxide stored within prefilled carbon dioxide gas cartridges or containers, a heating system device body, an intake chamber or tube to facilitate the introduction of carbon dioxide enriched air into the system, a canister body containing Group IA and IIA metal hydroxides, a heat-radiating element to direct the heat generated within the heating system device body, and an exhaust element to release the heat generated. The system performs a chemical reaction operation between carbon dioxide and Group IA and IIA metal hydroxides to create an exothermic heat reaction that achieves the ability to heat spaces and objects.

17 Claims, 8 Drawing Sheets

CHEMICAL REACTION HEATING SYSTEM

CROSS-REFERENCE APPLICATION

This is a Non-Provisional application claiming priority to Provisional Application No. 61/762,975 entitled Chemical Reaction Heating System by Bryant et al. filed on Feb. 11, 2013, the contents of which are incorporated herein in its entirety.

FIELD OF THE INVENTION

The present invention relates to a method and a chemical reaction heating system. In particularly, the present invention relates to methods and a chemical reaction heating system that uses carbon dioxide and Group IA and IIA metal hydroxides to produce an exothermic heat reaction, in which the heat is purposefully directed to the space or object being heated.

DESCRIPTION OF RELATED ART

There are several heating systems which are used to generate heat in different types of environments (indoors and outdoors). One type of heating system is a flammable gas stove which may be used in a mountaineering environment, for example. A mountaineer that may be melting ice and snow, for drinking water, within a tent may use the flammable gas stove in which a pot filled with ice and snow is placed on upon the flammable gas stove. There are several concerns when using a flammable gas stove that may include the gas emissions from the flame containing carbon monoxide and requiring the mountaineer to ventilate the tent in order to prevent carbon monoxide poisoning. Further, flammable gas stoves are highly inefficient at extremely high altitudes. Due to less dense air at high altitudes, the flames produced from the stove are less hot. At high altitude, there are less oxygen molecules per square foot than at lower elevations. Flammable gas stoves also present a hazard to the mountaineer and their equipment when incorrectly used. It is not uncommon for an uncontrolled fire to occur from the improper use of the flammable gas stove.

Another type of heating system is a fixed mounted hot-water radiator within a room of a domicile. The use of a fixed mounted hot-water radiator requires the use of a furnace to heat hot water. The hot water travels through pipes from the furnace to the hot-water radiator in a room. As the hot water travels through the pipes, the heat of the water dissipates before reaching the hot-water radiator in the room. Therefore, the travel distance between the furnace and the room's hot-water radiator creates inefficiency with heating the room.

There are some heating systems which achieve heat, via an exothermic reaction, through the combining of chemicals. For example, United States Patent Application Serial Number 2012/0210996 A1 which relates to a flameless heating apparatus for food products that achieves exothermic heat, by adding water to an alloy powder dispersed throughout a porous polyethylene matrix, to create a non-sustained heating effect without directing that heat towards the object being heated. However, the gas emission from the chemical mixture, hydrogen, is not conducive human's inhalation of the hydrogen rich air within a confined environment.

Other heating systems have been created that combine Group IA and IIA metal hydroxides and carbon dioxide. For example, U.S. Pat. No. 5,964,221 which relates to a rebreather adsorbent system for use in a self-contained breathing apparatus. This breathing device uses mixtures of Group IA and IIA metal hydroxides for "scrubbing" the carbon dioxide from a person's exhaled breath. "Scrubbing" is the process of converting carbon dioxide to oxygen, thus enabling a person to retain and reuse some, or all, of their expired breath while using a breathing apparatus. The heat derived from the exothermic reaction of the "scrubbing" process is treated as a waste by-product and left simply to disperse into the surrounding environment.

SUMMARY OF THE INVENTION

The embodiments of the present invention obviate the above-identified problems by providing methods and a chemical reaction heating system that uses carbon dioxide and Group IA and IIA metal hydroxides to produce an exothermic heat reaction, in which the heat is purposefully directed to the space or object being heated.

One or more embodiments of the present invention provide a chemical reaction heating system comprised of a valved mask to capture and direct carbon dioxide from a user's exhaled breath into a tube or air intake chamber, a connecting mechanism to attach and control flow of carbon dioxide stored within prefilled carbon dioxide gas cartridges or containers, a heating system device body, an intake chamber or tube to facilitate the introduction of carbon dioxide enriched air into the system, a removable canister body containing Group IA and IIA metal hydroxides, a heat-radiating element to direct the heat generated within the heating system device body, and an exhaust element to release the heat generated. The system performs a chemical reaction operation between carbon dioxide and Group IA and IIA metal hydroxides to create an exothermic heat reaction that achieves the ability to heat spaces and objects.

Another embodiment of the present invention provides a method for generating heat using a chemical reaction heating system.

Additional features and advantages are realized through the techniques of the present invention. Other embodiments and aspects of the invention are described in detail herein and are considered a part of the claimed invention. For a better understanding of the invention with the advantages and the features, refer to the description and to the drawings.

BRIEF DESCRIPTION OF THE DRAWINGS

The subject matter which is regarded as the invention is particularly pointed out and distinctly claimed in the claims at the conclusion of the specification. The forgoing and other features, and advantages of the invention are apparent from the following detailed description taken in conjunction with the accompanying drawings in which:

DETAILED DESCRIPTION OF THE INVENTION

Embodiments of the present invention will now be discussed below with reference to FIGS. 1 through 7. The present invention is not limited to use of any particular components or combination of components and may vary as necessary.

Figure 1:
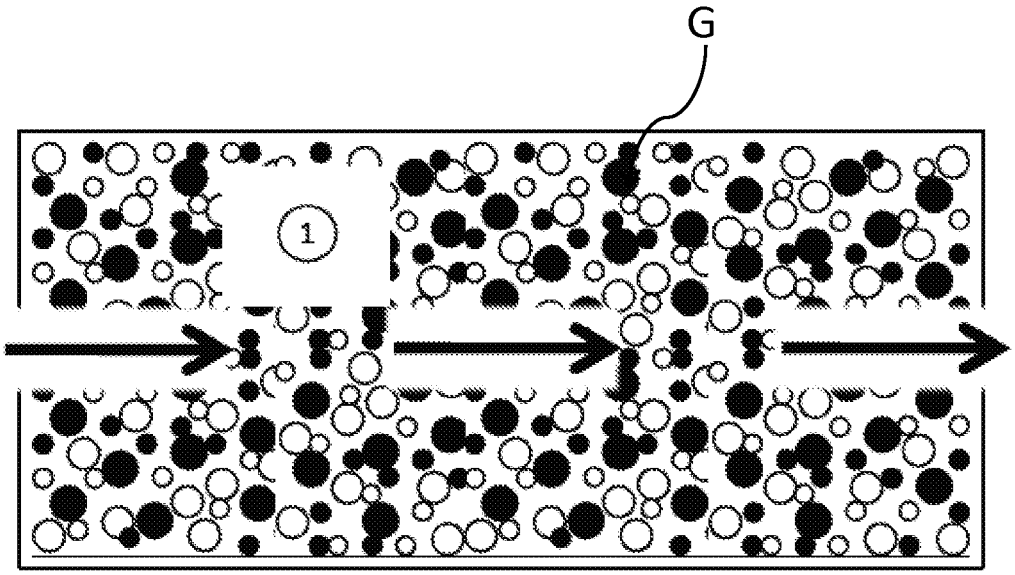
FIG. 1 is a cross-sectional top view of a canister body of a chemical reaction heating system according to one or more embodiments of the present invention.

FIG. 1 is a cross-sectional top view of a canister body 1 of a chemical reaction heating system 100, according to one or more embodiments of the present invention. As shown in FIG. 1, according to one or more embodiments, the canister body 1 is formed of granules of Group IA and IIA metal hydroxides.

Figure 2:
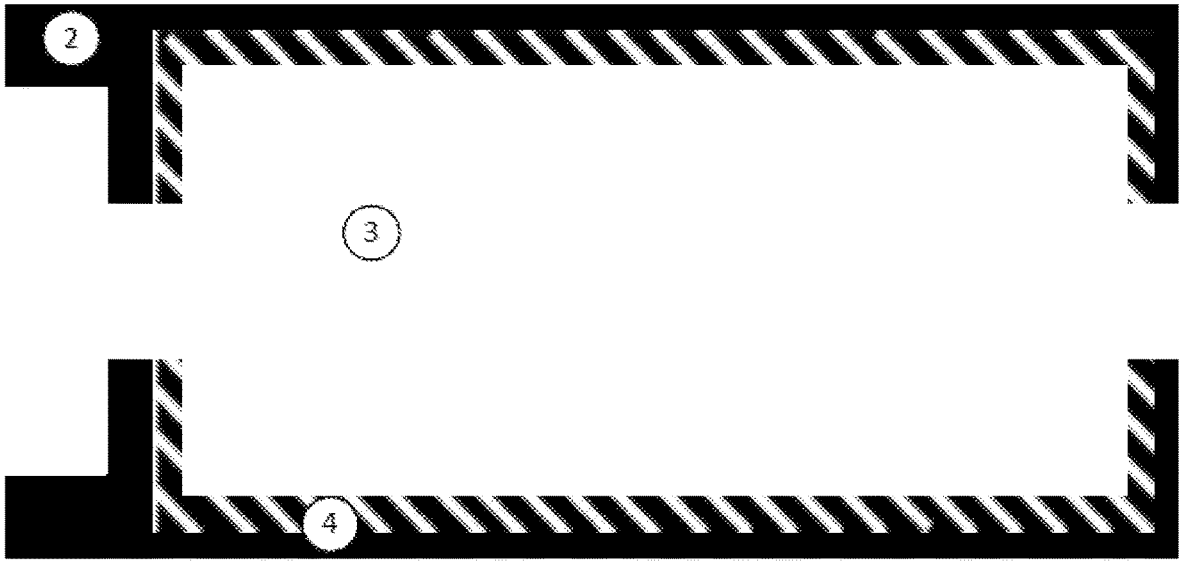
FIG. 2 is a cross-sectional top view of heating system device body of the chemical reaction heating system according to one or more embodiments of the present invention.

According to one or more embodiments, the canister body 1 may be a removable and/or refillable canister body. The removable canister body 1 may be characterized as removable canister body pre-formed into a cartridge for installation and removal within the heating system device body 2 (as depicted in FIG. 2). According to one or more embodiments, the canister body 1 may be a refillable canister body characterized in that the refillable canister body is able to be repeatedly installed and removed from the heating system device body to fill, empty, and refill the Group IA and IIA metal hydroxides.

According to one or more embodiments, a removable and/or refillable canister body 1 characterized in that an airflow passage allows carbon dioxide enriched air to enter into the removable or refillable canister body 1 from the air intake chamber 5 or tube or other supply means 6.

According to one or more embodiments, a removable or refillable canister body 1 is characterized in that the removable canister body contains granules G or other forms such as sheets, tubes, and other suitable combinations of Group IA and IIA metal hydroxides. According to one or more embodiments, the Group IA and IIA metal hydroxides consisting of calcium hydroxide, sodium hydroxide, potassium hydroxide, lithium hydroxide, and similar mixtures to generate exothermic heat reaction when coming into contact with carbon dioxide enriched air.

According to one or more embodiments, the removable canister body 1 is characterized in that an airflow passage allows carbon dioxide enriched air to flow through the removable or refillable canister body to contact the Group IA and IIA metal hydroxides. The canister body 1 is characterized in that the arrangement of Group IA and IIA metal hydroxides is arranged to create at least one airflow gap through the canister body 1. The canister body 1 is further characterized in that heat is achieve by the interaction between carbon dioxide and Group IA and IIA metal hydroxides and a chemical interaction between the carbon dioxide and metal hydroxides creates heated gas emissions of warm and breathable air.

FIG. 2 is a cross-sectional top view of heating system device body 2 of the chemical reaction heating system 100 according to one or more embodiments of the present invention.

As shown in FIG. 2, the heating system device body 2 includes a canister bay 3 configured to receive the canister body 1 (as depicted in FIG. 1) therein. The heating system device body 2 may be formed of a rectangular shape or any other suitable shape and size as desired. A heat-radiating element 4 is formed on along an inner surface of the canister bay 3 and configured to facilitate the directing of heat within the system 1. Specifically, the heat-radiating element 4 is configured to control how the heat from the canister bay 3 is radiated. The heat-radiating element 4 may be in the form of metal plates, metal wires, and/or heat-reflecting insulating material that traps heat so that it can radiate or escape the system 100 in a desired manner. Any suitable heat-radiating element may be used for the purposes set forth herein.

According to one or more embodiments, the canister bay 3 is used for the inserting of the removable and/or refillable canister body 1 into the device body. According to alternative embodiments, the canister bay 3 may be directly filled with Group IA and IIA metal hydroxides in lieu of the Refillable Canister Body.

According to one or more embodiments, the heat-radiating element 4 is characterized in that a heat barrier exists between the aforementioned heating system device body 2 and the aforementioned removable canister body 1 to direct the heat generated from the exothermic heat reaction to the heat-radiating element 4.

According to one or more embodiments, the heat-radiating element 4 is characterized in that the heat barrier thereof utilizes gel, foil, plates, fabric, and other suitable materials to facilitate the exchange of heat to the heat-radiating element 4.

According to one or more embodiments, a shape and size of the heat-radiating element 4 is configurable to correspond to the heating of an intended object using this chemical reaction heating system 100. That is, the heat-radiating element 4 is formed to a shape and configuration that allows the transferring of heat, via elongate heating elements extending from the heat-radiating element, into objects that are not directly in contact with a location of the exothermic heat reaction.

Figure 3:
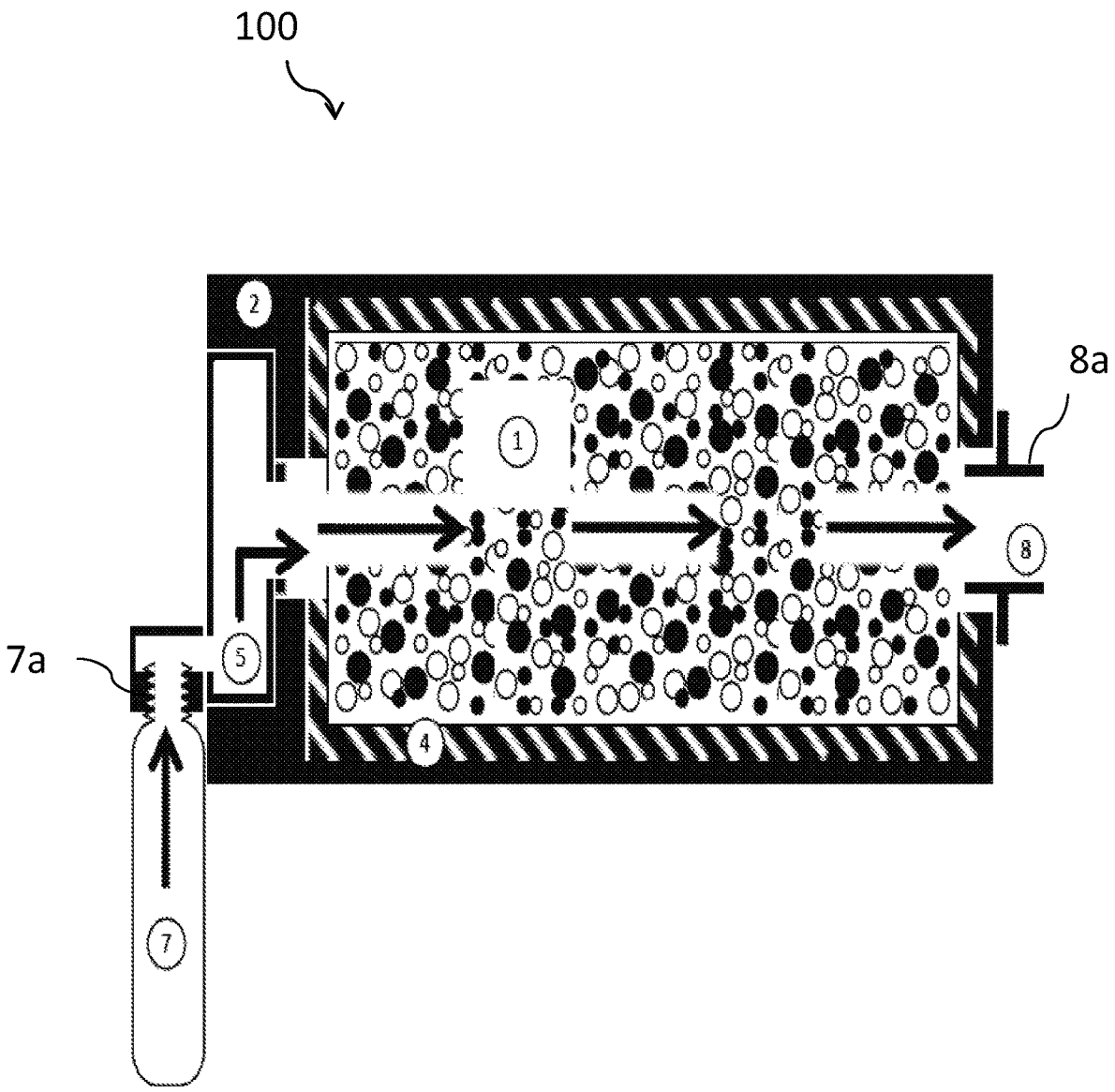
FIG. 3 is a cross-sectional top view of the heating system device body including the canister body of the chemical reaction heating system according to one or more embodiments of the present invention.

FIG. 3 is cross-sectional top view of the heating system device body 2 including the canister body 3 of the chemical reaction heating system 100 according to one or more embodiments of the present invention. As shown in FIG. 3, the canister body 1 is received in the canister bay 3. According to one or more embodiments, the system 100 further includes an intake chamber 5 to facilitate the introduction of carbon dioxide enriched air into the system 100. The heating system device body 2 includes the intake chamber 5. The intake chamber 5 is adjacent at a side of the canister body 1 and directs carbon dioxide into the heating system device body 2 to interact with the granules G of Group IA and IIA metal hydroxides of the canister body 1. According to one or more embodiments, the heating system device body 2 may contain the intake chamber 5 or be attached to a separate intake chamber 5 or tube or other supply means 6.

According to one or more embodiments, the heating system device body 2 may contain or attach the removable canister bay 3 of Group IA and IIA metal hydroxides.

According to one or more embodiments, the system 100 further includes one or more containers 7 e.g., gas cartridges prefilled with carbon dioxide and a connecting mechanism 7*a* to attach the containers 7 to the heating system device body 2, to control the flow of carbon dioxide stored within the containers 7. The carbon dioxide enters the intake chamber 5 and is directed into the heating system device body 2 to create a chemical reaction with the granules G of canister body 1.

According to one or more embodiments, an exhaust element including a coupling mechanism 8 is provided at another side of the heating system device body 2 opposite the side of the device body 2 which includes the intake chamber 5. The exhaust element and coupling mechanism 8 is configured to transmit heated gas emissions of warm and breathable air and/or elongated heating elements. According to one or more embodiments, the elongated heating elements can be metal wire, metal rods or air tubes that carry heated air in a desired direction.

Figure 4:
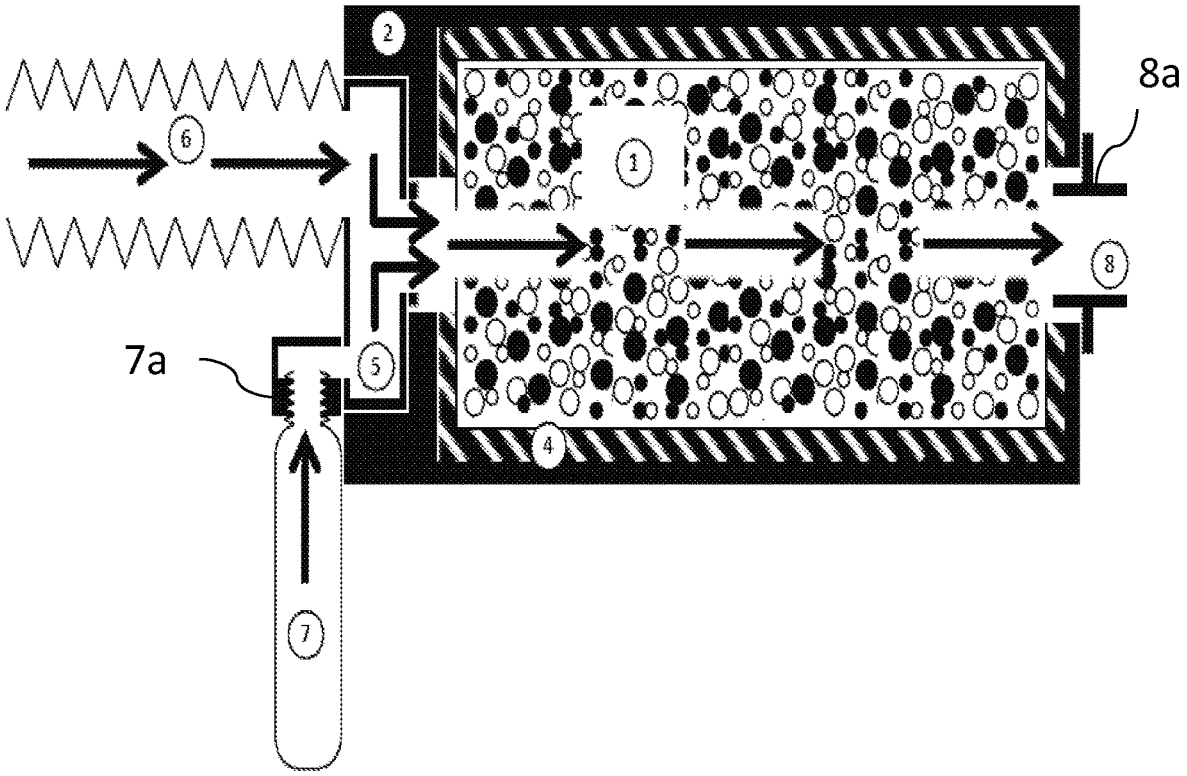
FIG. 4 is a cross-sectional top view of the heating system device body including the canister body and the intake tube of the chemical reaction heating system according to one or more embodiments of the present invention.
Figure 6:
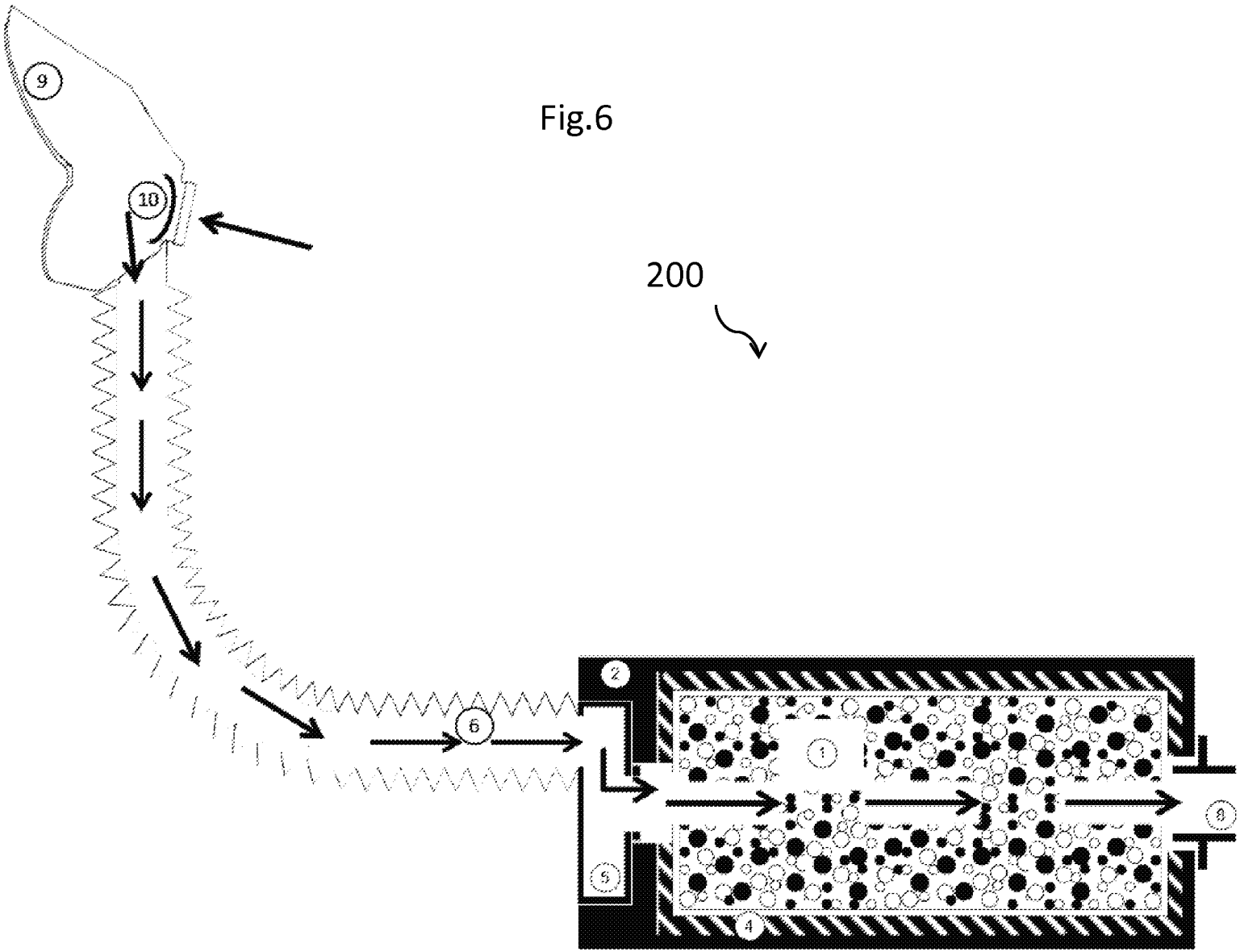
FIG. 6 is a view of the chemical reaction heating system according to one or more embodiments of the present invention.

The present invention is not limited to receiving carbon dioxide from containers 7, other method of inputting carbon dioxide into the system 100 may be implemented. FIG. 4 is cross-sectional top view of the heating system device body 1 including the canister body 2 and an intake tube 6 of the chemical reaction heating system 100 according to one or more embodiments of the present invention;

According to one or more embodiments, the intake tube or other supply means 6 is connected to another device (e.g., a mask as depicted in FIG. 6), for receiving a user's carbon dioxide enriched air into the system 100. The user's air travels through the intake tube or other supply means 6 and enters the intake chamber 5 before being introduced into the heating system device body 2. The user's air and the carbon dioxide stored within the containers 7 may be combined and inserted into the heating system device body 2 to create a chemical reaction with granules G using the heat radiating element 4. The heat generated is then transmitted through the exhaust element and coupling mechanism 8 to provide the heated gas emissions of warm and breathable air and/or elongated heating elements. According to one or more embodiments, a lesser amount of carbon dioxide may be released from the one or more containers 7 when the user's air is being received into the system 100.

The exhaust element 8 is configured to receive the heated gas emissions from the chemical interaction between the carbon dioxide and metal hydroxides, taking place within the removable or refillable canister body 1, with the heated gas emissions escaping via the exhaust element 8.

According to one or more embodiments, the exhaust element characterized in that a coupling mechanism is capable of being connected to the exhaust element to allow the exhausted gas emissions and heated air to exit the system 100, and transfer heat and air into a coupled or auxiliary object (e.g., a vest worn by the user).

According to one or more embodiments, the exhaust element 8 utilizes an exhaust port 8*a* allowing the exhausted gas emissions to exit the heating system device body 2. The gas emissions produced are conducive to a human's ability to breathe the exhausted air within a confined environment or space.

The coupling mechanism is connected to the exhaust port 8*a* to allow the exhausted gas emissions and heated air to exit the heating system device body 2 and transfer heat and air into a coupled and auxiliary object. The present invention is not limited to the configuration as shown in FIG. 4 and may therefore incorporate an airflow controlling mechanism to alternately control the flow of carbon dioxide from the containers 7 or the user's breath via the tube or other supply means 6 as shown in FIGS. 5*a* and 5*b* discussed below.

Figure 5A:
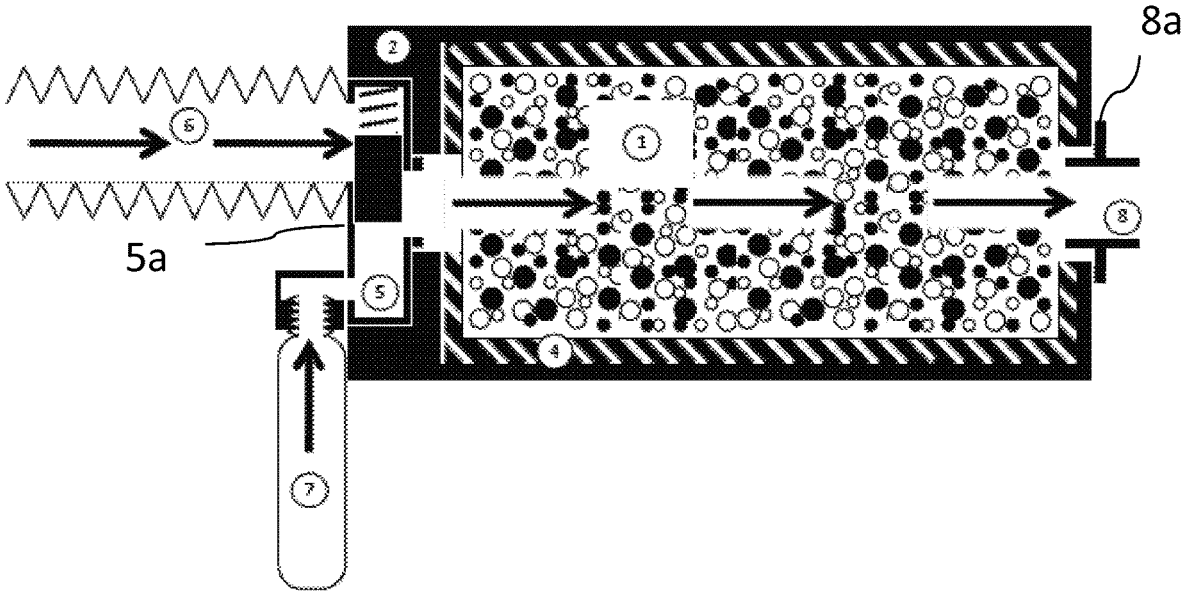
FIG. 5*a* is a cross-sectional top view of the heating system device body including the canister body and the intake tube where an airflow controlling mechanism controls the carbon dioxide to be received via a container attached to the chemical reaction heating system according to one or more embodiments of the present invention.

FIG. 5*a* is a cross-sectional top view of the heating system device body including the canister body and the intake tube where an airflow controlling mechanism 5*a* controls the carbon dioxide to be received via a container 7 attached to the system 100 according to one or more embodiments of the present invention. As shown in FIG. 5, the airflow controlling mechanism 5*a* includes an airflow controlling portion and an optional spring portion on a side thereof. In this embodiment, the airflow controlling mechanism 5*a* prevents the carbon dioxide from the cartridge or containers 7 from flowing back into the tube or other supply means 6.

According to one or more embodiments, when the cartridge or container 7 is inserted (as indicated by the arrow), the positive pressure of the carbon dioxide airflow from the cartridge or container 7 pushes the airflow controlling mechanism 5*a* to close the airway path within the intake tube 5 such that air cannot be received via a user from the tube or other supply means 6. Therefore, only carbon dioxide from the cartridge or container 7 is input into the canister bay 3.

Figure 5B:
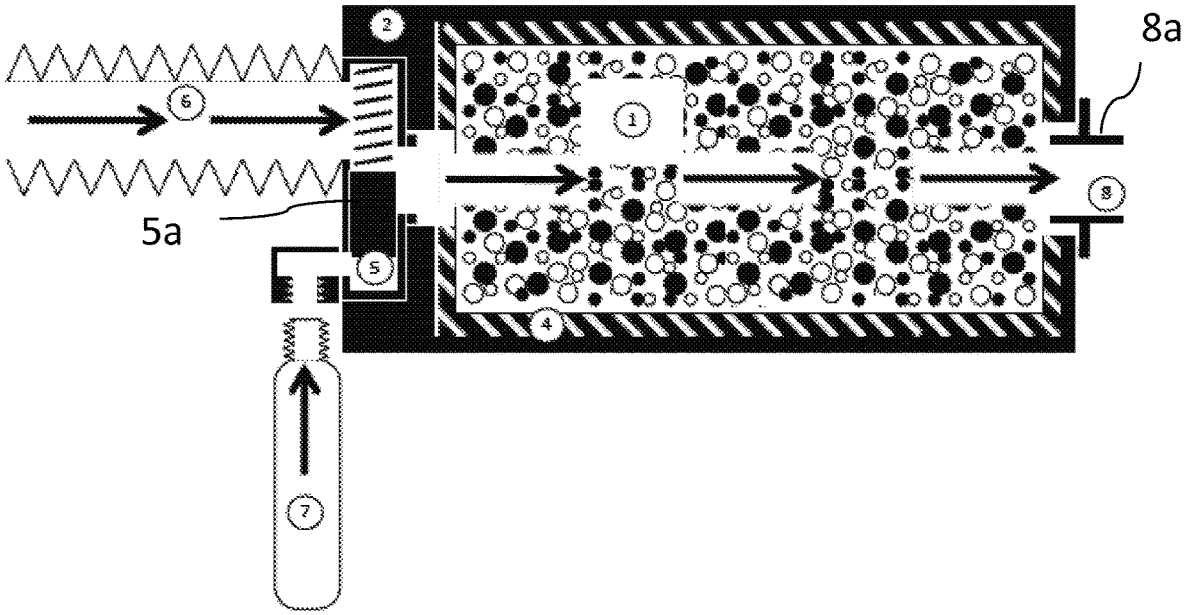
FIG. 5*b* is cross-sectional top view of the heating system device body including the canister body and the intake tube where an airflow controlling system controls the carbon dioxide to be received via a user of the chemical reaction heating system according to one or more embodiments of the present invention.

FIG. 5*b* is cross-sectional top view of the heating system device body including the canister body and the intake tube where the airflow controlling mechanism 5*a* controls the flow of carbon dioxide to be received via a user of the system according to one or more embodiments of the present invention. FIG. 5*b* is an alternative implementation of the process shown in FIG. 5*a*. As shown in FIG. 5*b*, when the cartridge or container 7 is removed, there is no positive air pressure against the airflow controlling mechanism 5*a*, therefore the spring portion forces the airflow controlling mechanism 5*a* into a position to allow the user's breathed air to flow through the system 100 into the canister bay 3.

According to another embodiment of the present invention, when using camping stoves and domicile heaters, for example, the system may include a screw mechanism to move the airflow controlling mechanism 5*a* to variably adjust and control the amount of carbon dioxide entering system 100, thereby controlling the amount of heat generated within the system 100.

One example of the implementation of the chemical reaction heating system 100 is shown in FIG. 6. The present invention is not limited to any particular implementation and may vary as necessary.

FIG. 6 is a view of the chemical reaction heating system 200 according to one or more embodiments of the present invention. As shown in FIG. 6, the chemical reaction heating system 200 comprises a valved mask 9 including an intake valve 10 at a front surface thereof to capture and direct carbon dioxide from a user's exhaled breath into a tube or other supply means 6 to be transmitted into the air intake chamber 5 of the heating system device body 2. The connecting mechanism 7*a* which is attach to and controls the flow of carbon dioxide stored within prefilled carbon dioxide gas cartridges or containers 7 is also provided. The carbon dioxide from the user's exhaled breath and/or the containers 7 are input into the heating system device body 2. The removable canister body 3 inserted into the heating system device body 2 containing Group IA and IIA metal hydroxides interacts with the carbon dioxide received therein creating an exothermic heat reaction. The heat created is transferred to the heat-radiating element 4 at the perimeter of the canister body 3. Then the heat is directed via the heat-radiating element and released from the system 100 via the exhaust element 8 to heat spaces and objects. The present invention is not limited to the use of a mask for receiving the user's air and any suitable device for the purpose set forth herein may be used.

According to one or more embodiments, the intake valve 10 of the mask 9 opens to allow a user to inhale ambient air, the intake valve 10 automatically closing at the end of the user's inhale and the beginning of the user's exhale, the user's exhale being directed into the intake chamber or tube. According to one or more embodiments, the positive pressure from the user's exhaled breath within the mask 9 causes the intake valve 10 to close automatically.

According to one or more embodiments, the heating system device body 2 is characterized in that the air intake chamber 5 supports one or more methods to introduce carbon dioxide enriched air into the system, for example, via the valved mask 9 or via containers 7 prefilled with carbon dioxide.

According to one or more embodiments, the air intake chamber 5 is characterized in that the air intake chamber 5 includes a method to transfer a human's exhaled breath, containing carbon dioxide, into the air intake chamber 5.

According to one or more embodiments, the air intake chamber 5 allows for insertion and connecting of prefilled carbon dioxide gas cartridges or containers 7 to introduce carbon dioxide enriched air into the air intake chamber 5.

According to one or more embodiments, the air intake chamber 5 is characterized in that the air intake chamber 5 achieves a combination of the transfer a user's exhaled breath and the connecting of prefilled carbon dioxide gas cartridges or containers 7 to introduce carbon dioxide enriched air into the air intake chamber 5, simultaneously.

As shown in FIGS. 5*a* and 5*b*, according to one or more embodiments, the airflow controlling mechanism 5*a* may be provided for controlling the carbon dioxide entering into the air intake chamber 5.

Figure 7:
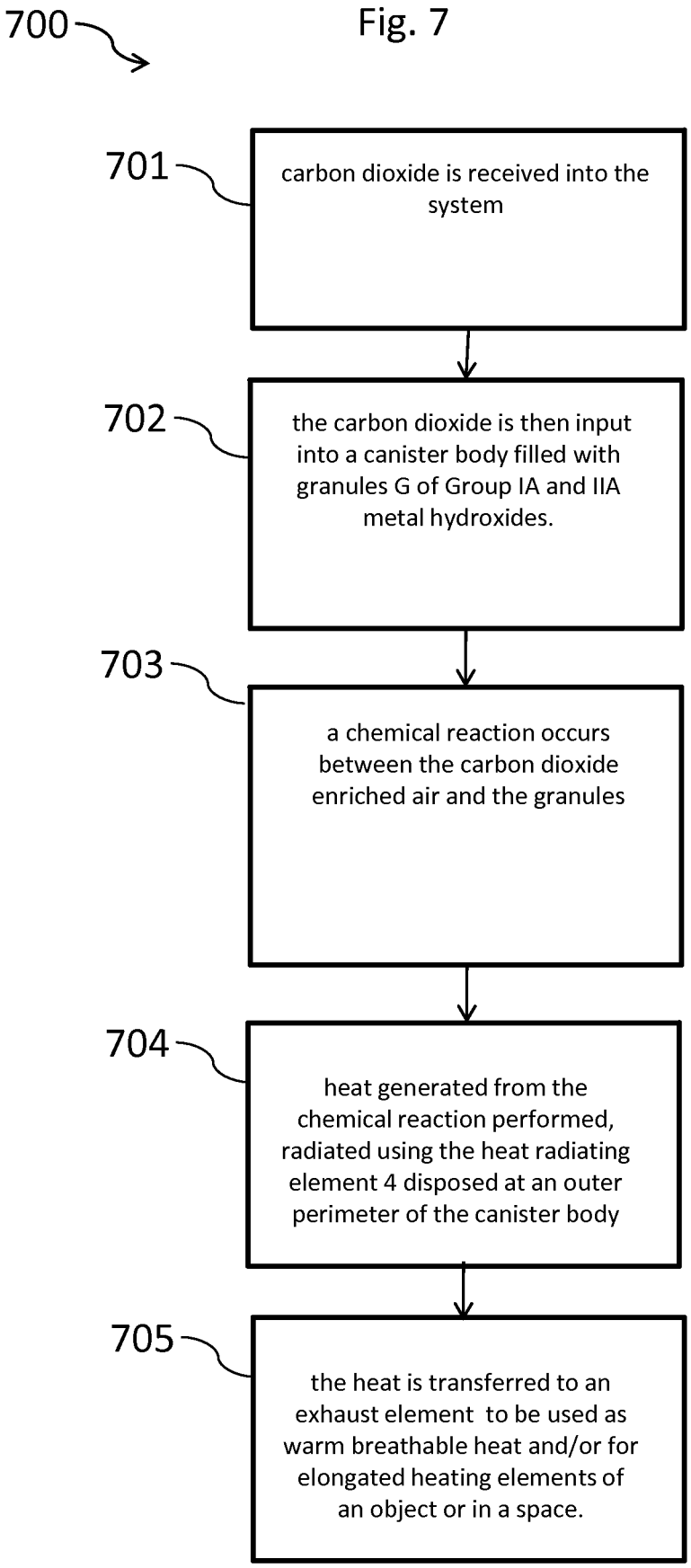
FIG. 7 is a flow diagram of a method of generating heat using the chemical reaction heating system shown in FIG. 6, according to one or more alternative embodiments of the present invention.

FIG. 7 is a flow diagram of a method 700 of generating heat using the chemical reaction heating system shown in FIG. 6, according to one or more alternative embodiments of the present invention.

As shown in the method 700, the process begins at operation 701 where carbon dioxide is received into the system 100. The carbon dioxide may be received via a valved mask 9 (as shown in FIG. 6) in which a user places the valved mask 9 of the chemical reaction heating system 200 over his/her face and breathes ambient air into the system 200 via an intake valve 10 of the mask 9. Alternatively or in combination, carbon dioxide may be received via cartridges or containers 7 prefilled with carbon dioxide (as shown in FIGS. 3 and 4).

If the carbon dioxide is received via the valved mask, the air received from the user is transmitted through a tube or other supply means 6 to an intake chamber 5 of the system 100. From operation 701, the process continues to operation 702, where the carbon dioxide enriched air is then input into the canister bay 3 including the canister body 1 filled with granules G of Group IA and IIA metal hydroxides.

From operation 702, the process continues to operation 703, where a chemical reaction occurs between the carbon dioxide enriched air and the granules G.

From operation 703, the process continues to 704, where heat generated from the chemical reaction performed, is radiated using the heat-radiating element 4 disposed at an outer perimeter of the canister body 1.

From operation 704 the process continues to operation 705, where the heat is transferred to an exhaust element 8 to be used as warm breathable heat and/or for elongated heating elements of an object, such as a vest worn by a user or in a space.

Therefore, embodiments of the present invention provide a method and a system 100 that achieves the ability to heat spaces and objects through chemical interaction between carbon dioxide and Group IA and IIA metal hydroxides.

According to one or more embodiments, the size and shape of the removable or refillable canister body 1 containing Group IA and IIA metal hydroxides, the heat-radiating element 4, and the exhaust element 8 is conducive for use as portable cooking and heating apparatus.

According to one or more embodiments, the size and shape of the removable or refillable canister body 1 containing Group IA and IIA metal hydroxides, the heat-radiating element 4, and exhaust element 8 are of proper configuration to support water lines traversing through the heat-radiating element 4 or the exhaust element 8, or both the heat-radiating element 4 and the exhaust element 8 to heat water inside of water pipes.

According to one or more embodiments, the size and shape of the removable or refillable canister body 1 containing Group IA and IIA metal hydroxides, the heat-radiating element 4, and the exhaust element 8 being of shape and method to transfer the heat, via elongate heating elements extending from the heat-radiating element 4 and/or exhaust element 8 into the intended object for heating and achieves the heating of sleeping mats, sleeping bags, blankets, clothing, and other similar objects.

According to one or more embodiments, the carbon dioxide within user's breath is captured and directed using a valved mask 9 (as depicted in FIG. 6) to facilitate the utility of the system 100 whereas the size and shape of the removable or refillable canister body 1 containing Group IA and IIA metal hydroxides, the heat-radiating element 4, and the exhaust element 8 is conducive to heating the space within clothing, sleeping bags, tents, and other spaces.

According to one or more embodiments, the system 100 may be implemented for use for an automobile, tent, or recreational camping trailer whereas the size and shape of the removable or refillable canister body 1 containing Group IA and IIA metal hydroxides, the heat-radiating element 4, and exhaust element 8 is conducive to heating the air within a confined environment or space by exhausting an emission of warm and breathable air.

According to another embodiment, the size and shape of the removable or refillable canister body 1 containing Group IA and IIA metal hydroxides, the heat-radiating element 4, and exhaust element 8 are designed to provide fixed or portable radiator for rooms within a domicile radiant heat and/or heated gas emission of warm and breathable air.

According to one embodiment, the source of carbon dioxide is from a user wearing the mask 9 and tube or supply means 6 configuration of the system 100 of the present invention to use their exhaled breath as the source of carbon dioxide. In extreme cold weather, the user may wear the chemical heating system inside of their clothing, or use it inside of a sleeping bag, tent, or other space. The radiant heat and the heated gas emissions from the chemical reaction heating system creates a heated microclimate within that space. The advantage of the heated microclimate is a reduction of the physiological burdens associated with the body's natural heat generating process. Additionally, the invention increases the amount of heat within the microclimate when compared to the body's natural heat generating process.

If a mountaineer uses the system 100 of the present invention, he puts on a facemask to capture their exhaled breath and direct the carbon dioxide enriched air into the system 100, thus creating an exothermic heat reaction within the invention. The exothermic reaction takes place within the system 100 and negates the potential of uncontrolled fire. With each exhaled breath, the mountaineer using this invention generates heat without being impacted by the density of the thin air and less oxygen molecules per square foot at higher altitude. As such, this invention is not impacted by the atmosphere conditions at high altitude. Because the gas emissions of this invention are conducive to a person breathing the emission in a closed environment, the mountaineer need not ventilate the tent.

According to one or more embodiments, when the system 100 of the present invention is placed within a room of a domicile, the system 100 generates heat from the exothermic reaction in the room. As such, no heat is lost as a result of the travel distances between a furnace and the room's hot-water radiator. Therefore, the system 100 of this embodiment has the capability to heat a room is much more efficient that the fixed mounted hot-water radiator that requires the use of a furnace and pipes.

The present invention provides advantages and/or alternatives over conventional heating systems in that embodiments of the present invention provides a method and chemical heating system that utilize a person's breath, containing carbon dioxide, and/or a prefilled carbon dioxide cartridge, to initiate and drive the chemical reaction that produces heat. Further, the gas emission from the exothermic reaction of this invention is conducive human's inhalation within a confined environment. Further still, this invention achieves the directing of heat to a heat-radiating element 4 for concentrated and sustained heating of an object. Further still, the heat-radiating element is configurable to match the object intended for heating. Further still, the heat-radiating element 4 is capable of being formed to a shape and configuration that allows the transferring of heat, via elongate heating elements extending from the heat-radiating element 4 and/or exhaust element 8 into objects that are not directly in contact with the exothermic reaction.

Further, embodiments of the present invention provide advantages and/or alternatives over conventional re-breather systems in that the present invention provides a method and a chemical reaction heating system that directs the heat gained from the exothermic reaction, to a heat-radiating element for concentrated and sustained heating of an object or space.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, element components, and/or groups thereof.

The corresponding structures, materials, acts, and equivalents of all means or step plus function elements in the claims below are intended to include any structure, material, or act for performing the function in combination with other claimed elements as specifically claimed. The description of the present invention has been presented for purposes of illustration and description, but is not intended to be exhaustive or limited to the invention in the form disclosed. Many modifications and variations will be apparent to those of ordinary skill in the art without departing from the scope and spirit of the invention. The embodiment was chosen and described in order to best explain the principles of the invention and the practical application, and to enable others of ordinary skill in the art to understand the invention for various embodiments with various modifications as are suited to the particular use contemplated While the preferred embodiment to the invention had been described, it will be understood that those skilled in the art, both now and in the future, may make various improvements and enhancements which fall within the scope of the claims which follow. These claims should be construed to maintain the proper protection for the invention first described.

What is claimed is:

1. A chemical reaction heating system comprising:

a heating system device body configured to create heat therein and comprising:

a canister bay formed within the heating system device body and including a longitudinal wall having two opposing end walls forming an exterior body, a single inlet at a first end and a single outlet at a second end opposite the first end;

a removable, refillable canister body formed of metal and comprising a single inlet and a single outlet aligned with the single inlet and the single outlet of the canister bay, respectively and configured to be received within the canister bay and filled with granules of Group IA and IIA metal hydroxides therein arranged to create an airflow passage or gap therebetween;

an intake chamber adjacent to the single inlet of the canister bay and the single inlet of the canister body and configured to: (i) receive carbon dioxide therein, to be inserted into the canister body and (ii) direct the flow of the carbon dioxide through the airflow passage or gap within the granules in the canister body to interact with the granules thereby initiating a chemical reaction with the Group IA and IIA metal hydroxides to create heat therein;

a heat barrier element disposed inside the canister bay and formed of metal along an inner surface of the longitudinal wall and the two opposing end walls of the canister bay, and the heat barrier element being sandwiched between the heating system device body and the canister body wherein the heat barrier element encircles the canister body housed within the canister bay and is configured to: create a heat barrier between the heating system device body and the canister body by reflecting the heat created from the chemical reaction back into the canister body, to facilitate directing of the flow of the heat created from the chemical reaction to an outside of the chemical reaction heating system; and an exhaust element communicatively coupled with the single outlet of the canister bay and configured to receive the heat created from the chemical reaction taking place within the canister body and heat reflected back into the canister body by the heat barrier element, and releasing the heat in the form of gas emissions with the heated, gas emissions escaping via the exhaust element to provide the heat to an object or space at the outside of the chemical reaction heating system.

2. The chemical reaction heating system of claim 1, further comprising:

at least one container or cartridge prefilled with carbon dioxide connected with the intake chamber via a connecting means, to supply carbon dioxide into the system.

3. The chemical reaction heating system of claim 1, further comprising:

a valved mask comprising an intake valve and configured to be worn by a user to enable the input of carbon dioxide from carbon dioxide enriched air when inhaled by the user; and a supply means connected with the valved mask and configured to receive the carbon dioxide from the carbon dioxide enriched air exhaled by the user.

4. The chemical reaction heating system of claim 1, wherein the canister bay is directly filled with the Group IA and IIA metal hydroxides.

5. The chemical reaction heating system of claim 1, wherein the exhaust element comprises an exhaust port formed to be coupled to an exhaust coupling mechanism for releasing the heat from the system.

6. The chemical reaction heating system of claim 1, wherein the heating system device body contains or is attached to the intake chamber.

7. The chemical reaction heating system of claim 1, wherein the Group IA and IIA metal hydroxides comprises at least one of calcium hydroxide, sodium hydroxide, potassium hydroxide, and lithium hydroxide.

8. The chemical reaction heating system of claim 1, wherein the Group IA and IIA metal hydroxides is in the form of the granules being arranged to create at least one airflow gap through the canister body.

9. The chemical reaction heating system of claim 1, further comprising:

at least one container or cartridge prefilled with carbon dioxide connected with the intake chamber via a connecting means, to supply carbon dioxide into the system;

a valved mask comprising an intake valve and configured to be worn by a user to enable the input of carbon dioxide from carbon dioxide enriched air when inhaled by the user; and a supply means connected with the valved mask and configured to receive the carbon dioxide from the carbon dioxide enriched air exhaled by the user.

10. The chemical reaction heating system of claim 9, further comprising an airflow controlling mechanism configured to alternately control the flow of carbon dioxide from the at least one container or cartridge or the valved mask and supply means, wherein when the at least one cartridge or container is inserted into the system positive pressure of the carbon dioxide from the at least one cartridge or container pushes the airflow controlling mechanism to close an airway path within the intake tube such that air cannot be received via a user from the supply means; and when the at least one cartridge or container is removed, there is no positive air pressure against the airflow controlling mechanism forcing the airflow controlling mechanism into a position to allow carbon dioxide enriched air from the user to flow through the system into the canister bay.

11. A method of generating heat using a chemical reaction heating system, the method comprises:

forming a canister bay within a heating system device body of the system including a longitudinal wall having two opposing end walls forming an exterior body, a single inlet at a first end and a single outlet at a second end opposite the first end;

receiving within the canister bay, a removable, refillable canister body formed of metal and comprising a single inlet and a single outlet aligned with the single inlet and the single outlet of the canister bay, respectively and filled with granules of Group IA and IIA metal hydroxides therein arranged to create an airflow passage or gap therebetween;

forming an intake chamber adjacent to the single inlet of the canister bay and the single inlet of the canister body and receiving carbon dioxide therein;

inserting the carbon dioxide into the canister body directly from the intake chamber, and directing, via the intake chamber the flow of the carbon dioxide through the airflow passage or gap within the granules of the canister body to interact with the granules thereby initiating a chemical reaction with the Group IA and IIA metal hydroxides to create heat therein;

creating, by a heat barrier element, a heat barrier between the heating system device body and the canister body by reflecting the heat created from the chemical reaction back into the canister body, to facilitate directing of the flow of the heat created from the chemical reaction to an outside of the chemical reaction heating system, wherein the heat barrier element disposed inside the canister bay and being formed of metal and formed along an inner surface of the longitudinal wall and the two opposing end walls of the canister bay, and the heat barrier element being sandwiched between the heating system device body and the canister body wherein the heat barrier element encircles the canister body housed within the canister bay; and receiving, via an exhaust element communicatively coupled with the single outlet of the canister bay, the heat created from the chemical reaction taking place within the canister body and heat reflected back into the canister body by the heat barrier element, and releasing the heat in the form of gas emissions with the heated, gas emissions escaping via the exhaust element to provide heat to an object or space at the outside of the chemical reaction heating system.

12. The method of claim 11, wherein the carbon dioxide is received via a valved mask used to enable a user to breath air into the chemical reaction heating system via an intake valve of the valved mask, and carbon dioxide of the air is inserted into the system using a supply means connected between the valved mask and an intake chamber connected with the heating system device body.

13. The method of claim 11, wherein the carbon dioxide is received via a cartridge or container prefilled with carbon dioxide and connected with an intake chamber connected with the heating system device body.

14. The method of claim 11, wherein the Group IA and IIA metal hydroxides comprises at least one of calcium hydroxide, sodium hydroxide, potassium hydroxide, and lithium hydroxide.

15. The method of claim 14, wherein the Group IA and IIA metal hydroxides is in the form of the granules being arranged to create at least one airflow gap through the canister body.

16. The method of claim 12, wherein a flow of carbon dioxide is controlled by an airflow controlling mechanism to alternately control the flow of carbon dioxide from at least one container or cartridge or the valved mask, wherein when the at least one cartridge or container is inserted into the system, positive pressure of the carbon dioxide from the at least one cartridge or container pushes the airflow controlling mechanism to close an airway path within the intake tube such that air cannot be received via a user from the supply means; and when the at least one cartridge or container is removed, there is no positive air pressure against the airflow controlling mechanism forcing the airflow controlling mechanism into a position to allow carbon dioxide enriched air from the user to flow through the system into the canister bay.

17. The chemical reaction heating system of claim 2, further comprising:

airflow controlling mechanism disposed within the intake chamber and configured to selectively control the flow of carbon dioxide to be received via the at least one container or cartridge.

* * * * *